US009126343B2

(12) United States Patent
Chen

(10) Patent No.: US 9,126,343 B2
(45) Date of Patent: Sep. 8, 2015

(54) FOLDING KNIFE WITH LOCKING MECHANISM

(71) Applicant: Shun-Fu Chen, New Taipei (TW)

(72) Inventor: Shun-Fu Chen, New Taipei (TW)

( * ) Notice: Subject to any disclaimer, the term of this patent is extended or adjusted under 35 U.S.C. 154(b) by 343 days.

(21) Appl. No.: 13/906,558

(22) Filed: May 31, 2013

(65) Prior Publication Data

US 2014/0020252 A1 Jan. 23, 2014

(30) Foreign Application Priority Data

Jul. 17, 2012 (TW) ..... 101213732 U

(51) Int. Cl.
*B26B 1/04* (2006.01)

(52) U.S. Cl.
CPC ..... *B26B 1/048* (2013.01)

(58) Field of Classification Search
CPC ..... B26B 1/04; B26B 1/042; B26B 1/044; B26B 1/048
USPC ..... 30/194, 262, 160–161
See application file for complete search history.

(56) References Cited

U.S. PATENT DOCUMENTS

| | | | | |
|---|---|---|---|---|
| 4,811,486 | A * | 3/1989 | Cunningham | 30/161 |
| 5,111,581 | A * | 5/1992 | Collins | 30/161 |
| 6,338,431 | B1 * | 1/2002 | Onion | 30/161 |
| 6,826,836 | B1 * | 12/2004 | Lin | 30/161 |
| 7,000,323 | B1 * | 2/2006 | Hatcher et al. | 30/155 |
| 7,243,430 | B1 * | 7/2007 | Lerch | 30/160 |
| 8,813,367 | B1 * | 8/2014 | Linn | 30/161 |
| 8,893,389 | B2 * | 11/2014 | Freeman | 30/155 |
| 8,939,054 | B2 * | 1/2015 | Hawk et al. | 83/13 |
| 8,966,770 | B2 * | 3/2015 | Lau | 30/161 |
| 9,061,426 | B2 * | 6/2015 | Harvey | 1/1 |
| 2006/0288585 | A1 * | 12/2006 | Kao | 30/159 |
| 2007/0137047 | A1 * | 6/2007 | Kim | 30/161 |
| 2007/0169354 | A1 * | 7/2007 | Ralph | 30/160 |
| 2011/0067247 | A1 * | 3/2011 | Huang | 30/161 |
| 2013/0326884 | A1 * | 12/2013 | Harvey | 30/161 |
| 2014/0047718 | A1 * | 2/2014 | Fellows et al. | 30/161 |

FOREIGN PATENT DOCUMENTS

| | | | | |
|---|---|---|---|---|
| FR | 2609923 | * | 1/1987 | B26B 1/048 |
| WO | WO2014/039254 | * | 3/2014 | B26B 1/046 |

* cited by examiner

*Primary Examiner* — Laura M Lee
(74) *Attorney, Agent, or Firm* — Bacon & Thomas, PLLC

(57) ABSTRACT

The present invention is to provide a folding knife, which includes an actuation element having one side provided with a pushing member and a sliding member and an opposite side provided with a locking member. The pushing member extends out of a handle through a pushing slide groove of the handle. The sliding member extends into a positioning slide groove of the handle and is located in an elastic ring. The locking member can extend into a curved groove of a blade. Once the blade is fully rotated out of the handle, the pushing member can be pushed toward the tip of the blade, causing the sliding member to pass through a limiting portion of the elastic ring and enter a locking area of the elastic ring. Consequently, the locking member is engaged in an opened-state locking groove of the curved groove and locks the blade in an opened state.

7 Claims, 7 Drawing Sheets

FOLDING KNIFE WITH LOCKING MECHANISM

FIELD OF THE INVENTION

The present invention relates to a folding knife, more particularly to a folding knife having a locking mechanism, which includes an actuation element having one side provided with a pushing member and a sliding member and an opposite side provided with a locking member. The pushing member extends out of a handle through a pushing slide groove of the handle. The sliding member extends into a positioning slide groove of the handle and is located in an elastic ring. The locking member can extend into a curved groove of a blade. Once the blade is fully rotated out of the handle, the pushing member can be pushed toward the tip of the blade, causing the sliding member to pass through a limiting portion of the elastic ring and enter a locking area of the elastic ring. Consequently, the locking member is engaged in an opened-state locking groove of the curved groove and locks the blade in an opened state. Once the blade is fully folded into the handle, the actuation element can be pushed away from the tip of the blade so that the sliding member passes through the limiting portion of the elastic ring and enters a locking area of the elastic ring. Thus, the locking member is brought into engagement in the folded-state locking groove of the curved groove to lock the blade in the folded state

BACKGROUND OF THE INVENTION

With the improvement of living standards, people are placing more and more emphasis on outdoor recreational activities, some common examples of which are mountaineering and cycling. Take mountaineering for example. It is not unusual that a mountaineer carries a folding knife with them to chop or cut off prickly shrubs or branches. A commercially available folding knife is typically composed of a handle and a blade, wherein the blade is pivotally connected to the handle so as to spin out of or fold into the handle. Once the blade is rotated out of the handle, the folding knife is ready for chopping or cutting. However, according to years of observation by the present inventor, the blade is very likely to rotate back into the handle automatically during use if the force applied by the user to the folding knife is too large or is at an inappropriate angle. Should the blade fold into the blade under such circumstances, the user's hand may be cut, which is highly dangerous.

To address the safety issue of the conventional folding knives, structural improvements have been made to bring about a folding knife with an elastic stop plate as shown in FIG. 1. The improved folding knife 1 includes a handle 10 and a plate element 10*a* disposed therein. The plate element 10*a* is provided with an elastic stop plate 11. A blade 12 is pivotally connected to one side of the plate element 10*a* and can be rotated into and out of the handle 10. Once the blade 12 is folded in the handle 10, the elastic stop plate 11 presses against a lateral side of the blade 12 resiliently, thanks to the elasticity of the elastic stop plate 11. As soon as the blade 12 is rotated, or springs, out of the handle 10, the free end of the elastic stop plate 11 (i.e., the lower right end as shown in FIG. 1) moves elastically toward the blade 12. More specifically, the free end of the elastic stop plate 11 will move to a position adjacent to one end of the blade 12 (i.e., the end away from the blade tip) and press against the blade 12, as shown in FIG. 1.

In the state shown in FIG. 1, the blade 12, which is pressed against by the elastic stop plate 11, cannot fold easily into the handle 10. Even if the user attempts to rotate the blade 12 into the handle 10, the elastic stop plate 11 pressing against the blade 12 will prevent the attempt from succeeding. If the user really wants to fold the blade 12, it is required to press the elastic stop plate 11 first so that the elastic stop plate 11 is moved away from the position where it can press against the blade 12. Only then can the blade 12 be rotated by the user. However, when the user holds the folding knife 1 by the handle 10 and performs a thrusting or chopping action with an excessively large force or at an improper angle, the resulting shocks or other reaction forces may also drive the elastic stop plate 11 away from the position where it can press against the blade 12. Should this happen, the blade 12 will rotate toward the handle 10 instantaneously and may thus injure the user's hand. It can be known from the above that both the conventional folding knives and the improved ones are not safe enough and therefore cannot be used with peace of mind. Moreover, neither the conventional nor the improved folding knives provide a reliable locking mechanism for locking the blade in the folded state. In the absence of such a locking mechanism, the blade in the folded state may, when activated or pushed out inadvertently, spin or spring out of the handle and injure the user as a result.

Hence, the issue to be addressed by the present invention is to overcome the various drawbacks of the existing folding knives and design a folding knife with a locking mechanism. It is desirable that the locking mechanism can lock the blade of the folding knife in the folded state as well as in the opened state, thus enhancing the safety and convenience of use of the folding knife.

BRIEF SUMMARY OF THE INVENTION

In view of the drawbacks of the folding knives described above, the present inventor conducted extensive research and experiment and finally succeeded in developing a folding knife with a locking mechanism. The blade of this folding knife is prevented from folding or springing out by accident so that the user can use the folding knife safely without fear of being cut by the blade. In addition, the user can operate the locking mechanism of the folding knife single-handedly, which adds to the convenience of use of the folding knife.

It is an object of the present invention to provide a folding knife having a locking mechanism, wherein the folding knife includes a handle, a blade, an elastic ring, and an actuation element. The handle includes a first plate element and is provided with a pivot pin. The first plate element is formed with a pushing slide groove and a positioning slide groove, both of which are adjacent to the pivot pin. The axial direction of the pushing slide groove is parallel to the axial direction of the positioning slide groove. A portion of the blade that is distant from the tip thereof is pivotally connected by the pivot pin to the first plate element at a position adjacent to one end of the first plate element. The blade is formed with a curved groove which is adjacent to the pivot pin and which extends along a circumferential direction defined by the pivot pin as the center. The curved groove has two terminal ends respectively extended with an opened-state locking groove and a folded-state locking groove, both of which locking grooves extend away from the pivot pin. The opened-state locking groove extends toward the tip of the blade while the folded-state locking groove extends away from the tip of the blade. The elastic ring is provided in the positioning slide groove. The middle section of the elastic ring is curved inward to form a limiting portion. As a result, the elastic ring defines a locking area and a releasing area which are respectively adjacent to two ends of the elastic ring. The actuation element is provided between the first plate element and the blade. The side of the actuation element that faces the first plate element is protrudingly provided with a pushing member and a sliding member. One end of the pushing member (hereinafter referred to as the first end of the pushing member) extends out of the first plate element through the pushing slide groove so as to be pushed by the user. The sliding member extends into the positioning slide groove and is located in the elastic ring. The opposite side of the actuation element is protrudingly provided with a locking member which corresponds in position to and can extend into the curved groove of the blade. Once the blade is fully rotated out of the handle, the actuation element can be pushed toward the tip of the blade, causing the sliding member of the actuation element to pass through the limiting portion of the elastic ring and enter the locking area. Consequently, the locking member is engaged in the opened-state locking groove and thereby locks the blade in the opened state. Once the blade is fully folded into the handle, the actuation element can be pushed away from the tip of the blade so that the sliding member of the actuation element passes through the limiting portion of the elastic ring and enters the locking area. Thus, the locking member is brought into engagement in the folded-state locking groove to lock the blade in the folded state. With the limiting portion capable of fixing the sliding portion in position, the actuation element can be securely engaged in the opened-state locking groove or the folded-state locking groove to ensure that the blade is secured in the opened or folded state. As such, the safety of the folding knife is effectively enhanced during use. Moreover, the folding knife features great convenience of use now that the actuation element can be operated single-handedly to lock the blade in place.

Another object of the present invention is to provide the foregoing folding knife, wherein the actuation element is provided with a rivet hole to which an opposite second end of the pushing member is fixed by riveting.

Yet another object of the present invention is to provide the foregoing folding knife, wherein the first end of the pushing member is provided with an anti-slip portion to facilitate operation.

Still another object of the present invention is to provide the foregoing folding knife, wherein the handle further includes a second plate element. The blade is pivotally provided between the first plate element and the second plate element, and the second plate element is provided with an elastic stop plate. When the blade in the opened state, one end of the elastic stop plate presses against the end of the blade that is adjacent to the pivot pin.

BRIEF DESCRIPTION OF THE SEVERAL VIEWS OF THE DRAWINGS

The technical features as well as further objects and effects of the present invention will be best understood by referring to the following detailed description of some illustrative embodiments in conjunction with the accompanying drawings, in which.

DETAILED DESCRIPTION OF THE INVENTION

Figure 1:
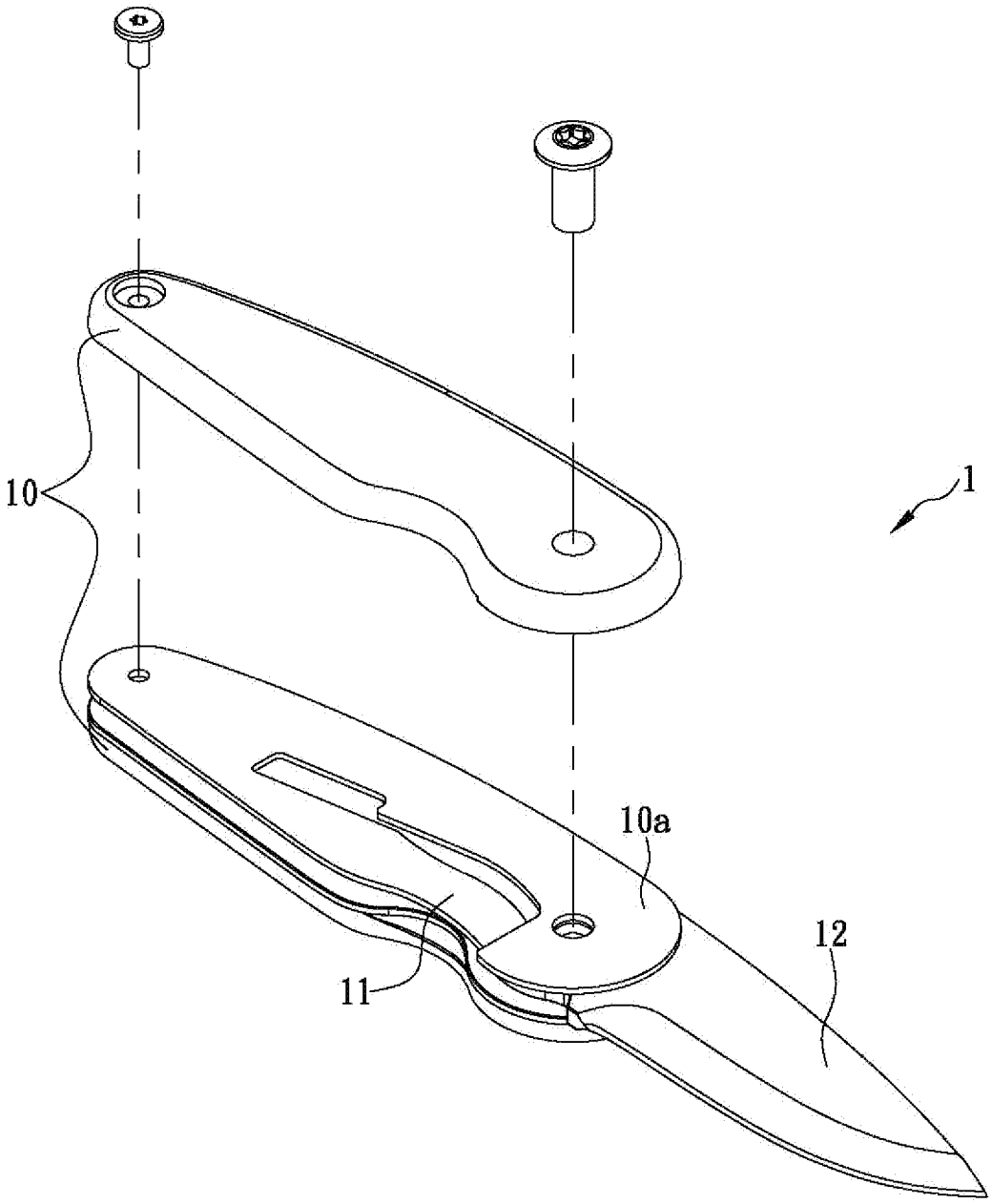
FIG. 1(Prior Art)
FIG. 1 is an exploded perspective view of a conventional folding knife.

The inventor of the present invention has long been engaged in research and development in the folding knife-related field. In the process, the inventor has found that the blade of a conventional folding knife tends to fold or pop out by accident during use and thereby injure the user. Although improvements have been made to incorporate an elastic stop plate into the conventional folding knife, with a view to securing the blade in the opened state, the elastic stop plate, when subjected to shocks or other external forces, may still be driven away from the position where it can press against the blade, hence failing to protect the user from being cut by the blade. The elastic stop plate also causes inconvenience in use. Besides, the conventional locking mechanisms can only lock blades in the opened state but not in the folded state. To solve the aforesaid problems, further improvements have been made to the folding knife structure, but an ideal solution has yet to be found. In consideration of this, the inventor came up with the idea of equipping a folding knife with a locking mechanism configured for single-handed operation and for keeping the blade securely in the folded state as well as in the opened state.

The present invention discloses a folding knife with a locking mechanism. In a preferred embodiment of the present invention, referring to FIG. 2, the folding knife 2 includes a handle 20, a blade 21, an elastic ring 22, and an actuation element 23, wherein the handle 20 includes a first plate element 201 and a second plate element 202. The handle 20 is provided with a pivot pin 200. The first plate element 201 is formed with a pushing slide groove 203 and a positioning slide groove 204, both of which are adjacent to the pivot pin 200. The axial direction of the pushing slide groove 203 is parallel to the axial direction of the positioning slide groove 204. A manufacturer wishing to make the pushing slide groove 203 and the positioning slide groove 204 of the first plate element 201 according to the technical features disclosed herein may adjust the lengths and widths of both grooves 203 and 204 to meet practical design requirements or user requirements. The intended effects of the present invention can be achieved even if the axial directions of the pushing slide groove 203 and the positioning slide groove 204 are not exactly parallel to each other. All adjustments and modifications readily conceivable by a person skilled in the art should be viewed as equivalent changes within the scope of the present invention.

Figure 2:
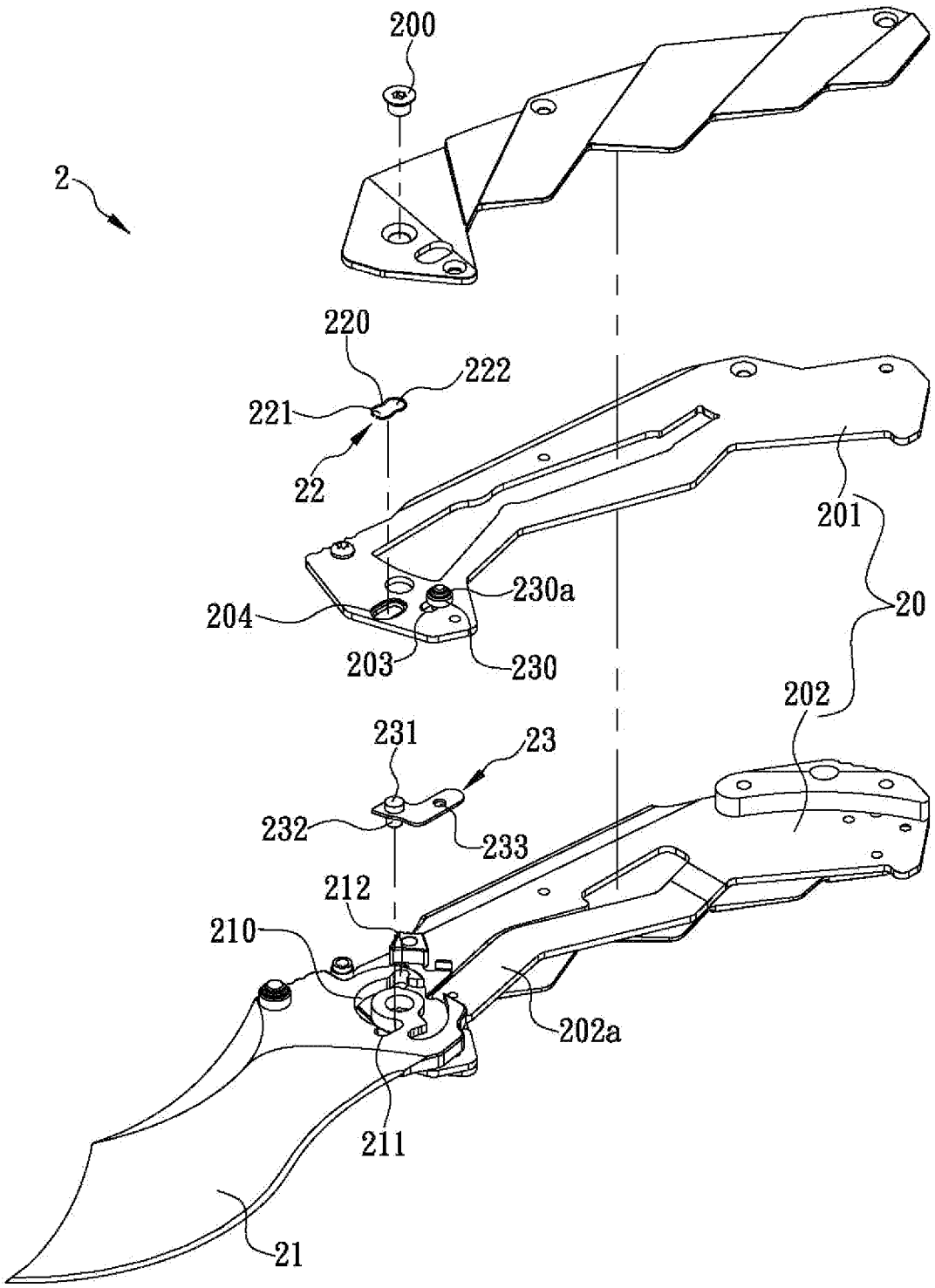
FIG. 2 is an exploded perspective view of a preferred embodiment of the present invention.

Referring again to FIG. 2, a portion of the blade 21 that is distant from the blade tip is pivotally connected by the pivot pin 200 to a portion of the first plate element 201 that is adjacent to one end thereof (i.e., the left end as shown in FIG. 2). Thus, the blade 21 is pivotally provided between the first plate element 201 and the second plate element 202. The blade 21 is formed with a curved groove 210 which is adjacent to the pivot pin 200 and which extends along a circumferential direction defined by the pivot pin 200 as the center. The two terminal ends of the curved groove 210 are respectively extended with an opened-state locking groove 211 and a folded-state locking groove 212, both of which locking grooves extend away from the pivot pin 200. More specifically, the opened-state locking groove 211 extends toward the blade tip (i.e., the left end of the blade 21 as shown in FIG. 2), and the folded-state locking groove 212 extends away from the blade tip. Nevertheless, the configurations of the curved groove 210, the opened-state locking groove 211, and the folded-state locking groove 212 are not limited to the above. For example, the distance between the curved groove and the pivot pin may be increased, and the opened-state locking groove and the folded-state locking groove may extend toward the pivot pin instead. In this preferred embodiment, the elastic ring 22 has an inwardly curved middle section that forms a limiting portion 220. As a result, the elastic ring 22 forms a locking area 221 and a releasing area 222 which are respectively adjacent to two ends of the elastic ring 22. Both the locking area 221 and the releasing area 222 are greater in width than the limiting portion 220. The elastic ring 22, which is provided in the positioning slide groove 204, can be constructed by an elastic steel wire or wires of other materials. Moreover, the elastic ring 22 may be a closed ring or a ring with a gap at one end, either of which configurations is conducive to the intended effects of the present invention. The present invention, however, is not limited to the foregoing configurations. All changes and modifications easily conceivable by a person skilled in the art should fall within the scope of the present invention.

Figure 3:
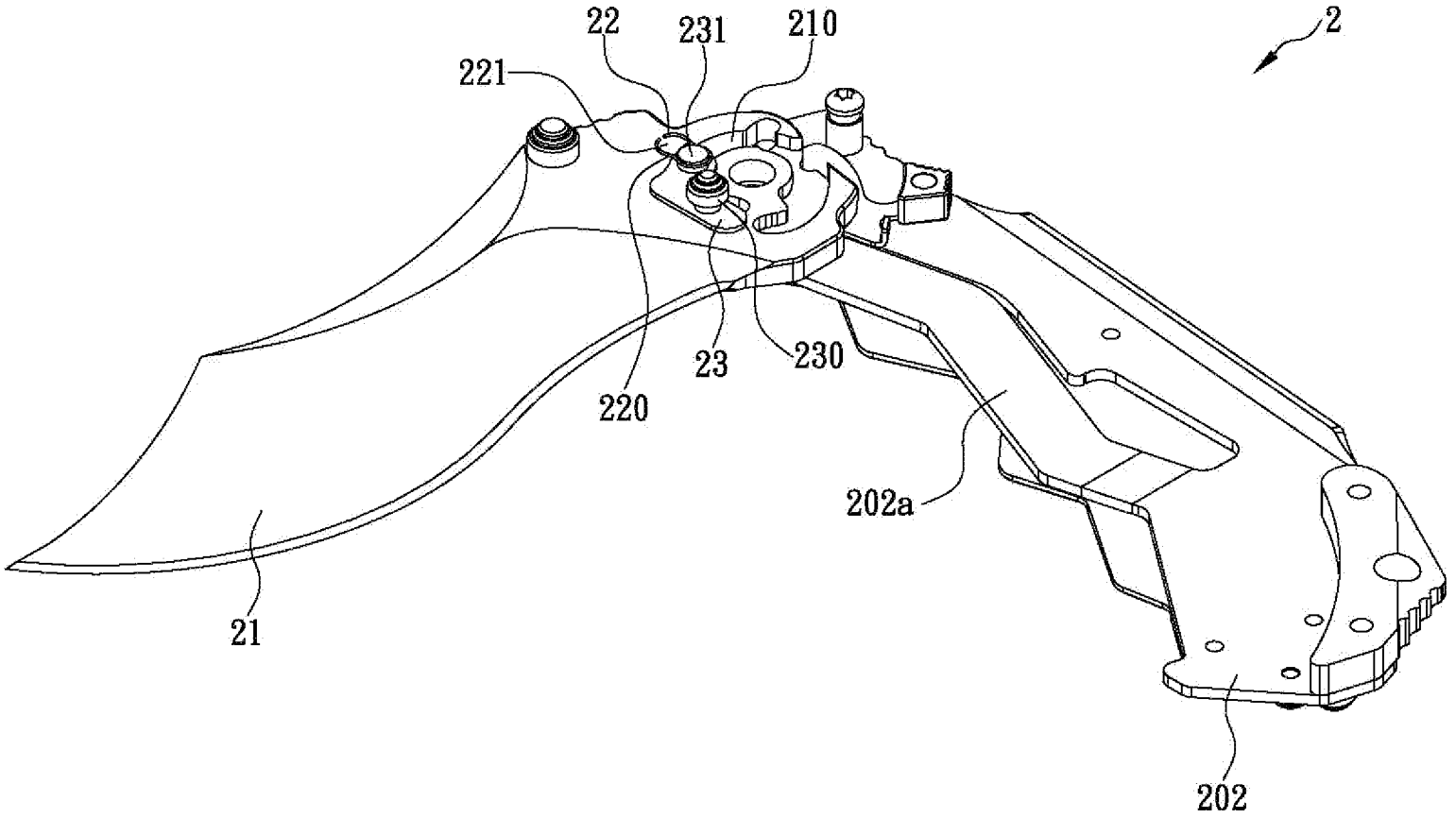
FIG. 3 is a partial perspective view of the preferred embodiment of the present invention.

Referring again to FIG. 2, the actuation element 23 is provided between the first plate element 201 and the blade 21. The side of the actuation element 23 that faces the first plate element 201 is protrudingly provided with a pushing member 230 and a sliding member 231. One end of the pushing member 230 (i.e., the top end as shown in FIG. 2) extends out of the first plate element 201 through the pushing slide groove 203 in order to be pushed by the user. This end of the pushing member 230 is also provided with an anti-slip portion 230*a* for ease of operation. In this preferred embodiment, the actuation element 23 is provided with a rivet hole 233, and the opposite end of the pushing member 230 (i.e., the bottom end as shown in FIG. 2) is fixed at the rivet hole 233 of the actuation element 23 by riveting. Nevertheless, the present invention is not limited to the foregoing design. The pushing member 230 may be, for example, integrally formed with the actuation element 23 instead. That is to say, the fixing mode of the pushing member 230 does not constitute a limitation of the present invention. Reference is now made to FIG. 2 and FIG. 3, the latter of which omits the first plate element 201 for the sake of clarity. The sliding member 231 extends into the positioning slide groove 204 and is located in the elastic ring 22. The width of the sliding member 231 is slightly greater than that of the limiting portion 220 and generally equal to that of the locking area 221 and the releasing area 222 (see FIG. 2). As the elastic ring 22 is provided in the positioning slide groove 204 of the first plate element 201, it will not move with the sliding member 231 of the actuation element 23 but stays at a fixed position in order to impose a limitation on the sliding member 231. When the pushing member 230 is pushed to move the sliding member 231, the sliding member 231 must pry the limiting portion 220 further open before it can move into the locking area 221 or the releasing area 222.

Figure 4:
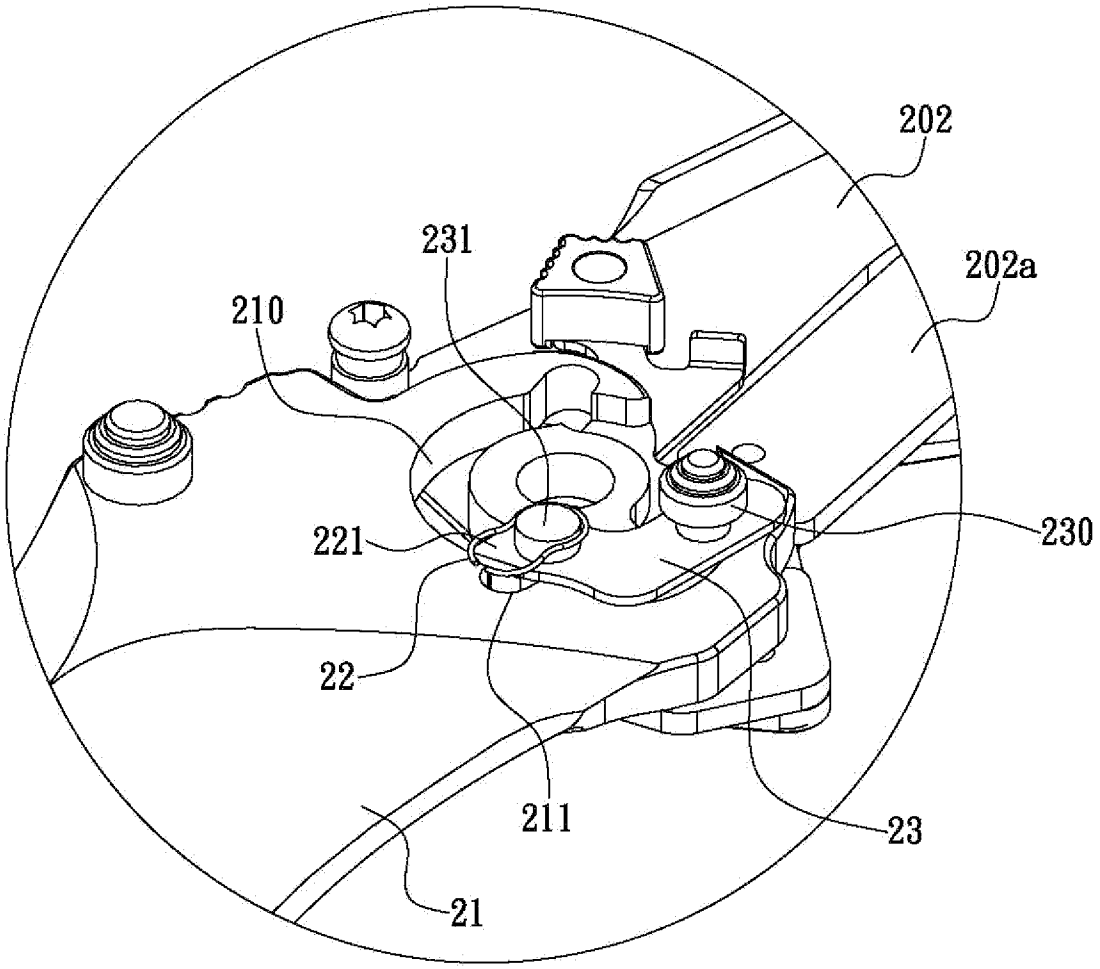
FIG. 4 is a partial enlarged view of the preferred embodiment of the present invention showing the blade in the opened state.
Figure 5:
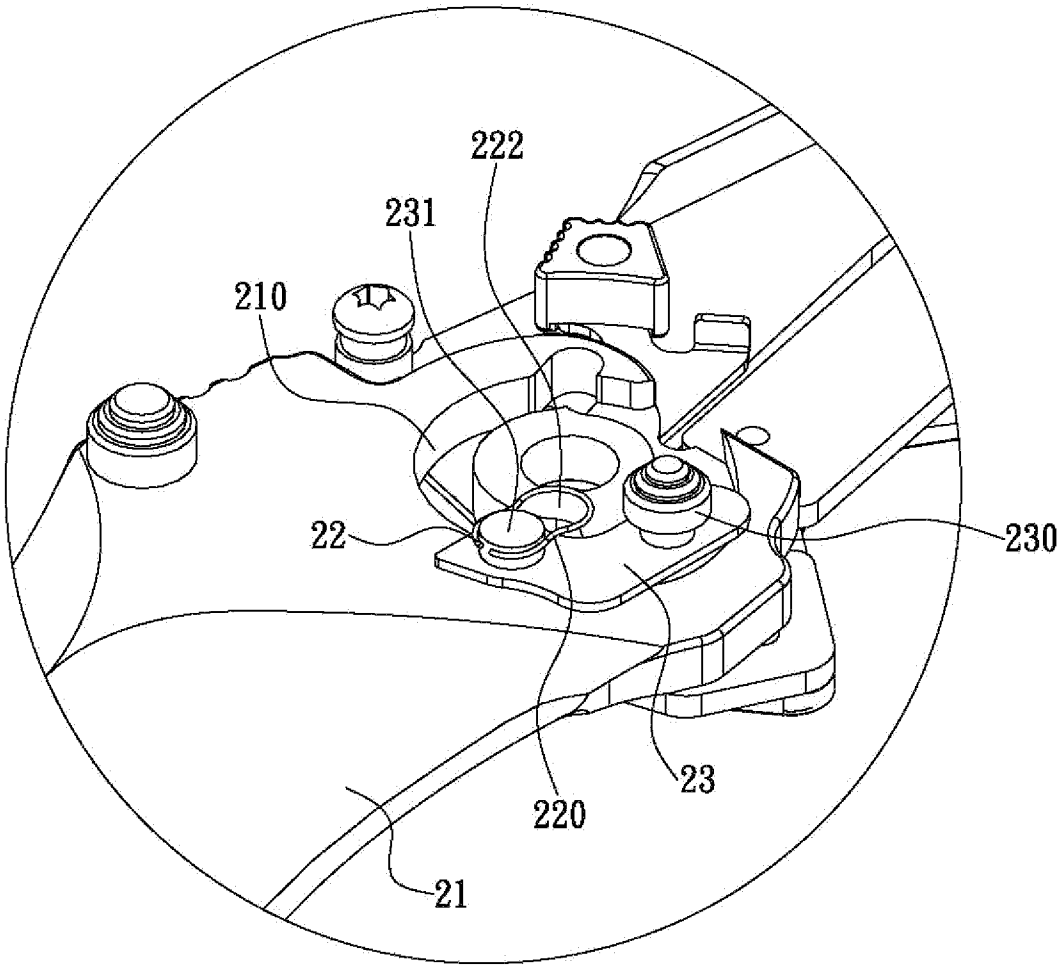
FIG. 5 is another partial enlarged view of the preferred embodiment of the present invention showing the blade in the opened state.

As shown in FIG. 2 and FIG. 3, the opposite side of the actuation element 23 is protrudingly provided with a locking member 232 which corresponds in position to and can extend into the curved groove 210 of the blade 21. In FIG. 3, in which the blade 21 is halfway through the opening (or folding) process, the locking member 232 (see FIG. 2) is in the curved groove 210 and therefore does not hinder rotation of the blade 21. In FIG. 4, in which the blade 21 has been opened (i.e., rotated out of the handle 20 to the full) but the actuation element 23 has yet to be pushed, the locking member 232 (which corresponds in position to the sliding member 231, as shown in FIG. 2) is not engaged in the opened-state locking groove 211, so the blade 21 is not locked by the actuation element 23. Referring to FIG. 5, when the actuation member 23 is subsequently pushed toward the tip of the blade 21, the sliding member 231 of the actuation element 23 moves from the releasing area 222 of the elastic ring 22 through the limiting portion 220 to the locking area 221 shown in FIG. 4. As a result, the locking member 232 (see FIG. 2) is engaged in the opened-state locking groove 211 shown in FIG. 4 and locks the blade 21 in the opened state. Apart from that, the second plate element 202 is provided with an elastic stop plate 202*a*. When the blade 21 is in the opened state, one end of the elastic stop plate 202*a* presses against the end of the blade 21 that is adjacent to the pivot pin 200, thus further securing the blade 21 in the opened state. When it is desired to fold the blade 21, the user only has to push the pushing member 230, and the locking member 232 (see FIG. 2) will be moved out of the opened-state locking groove 211 and resume its position in FIG. 4, meaning the blade 21 is no more locked. Now that the locking member 232 reenters the curved groove 210, the blade 21 can be rotated into the handle 20 as desired.

Figure 6:
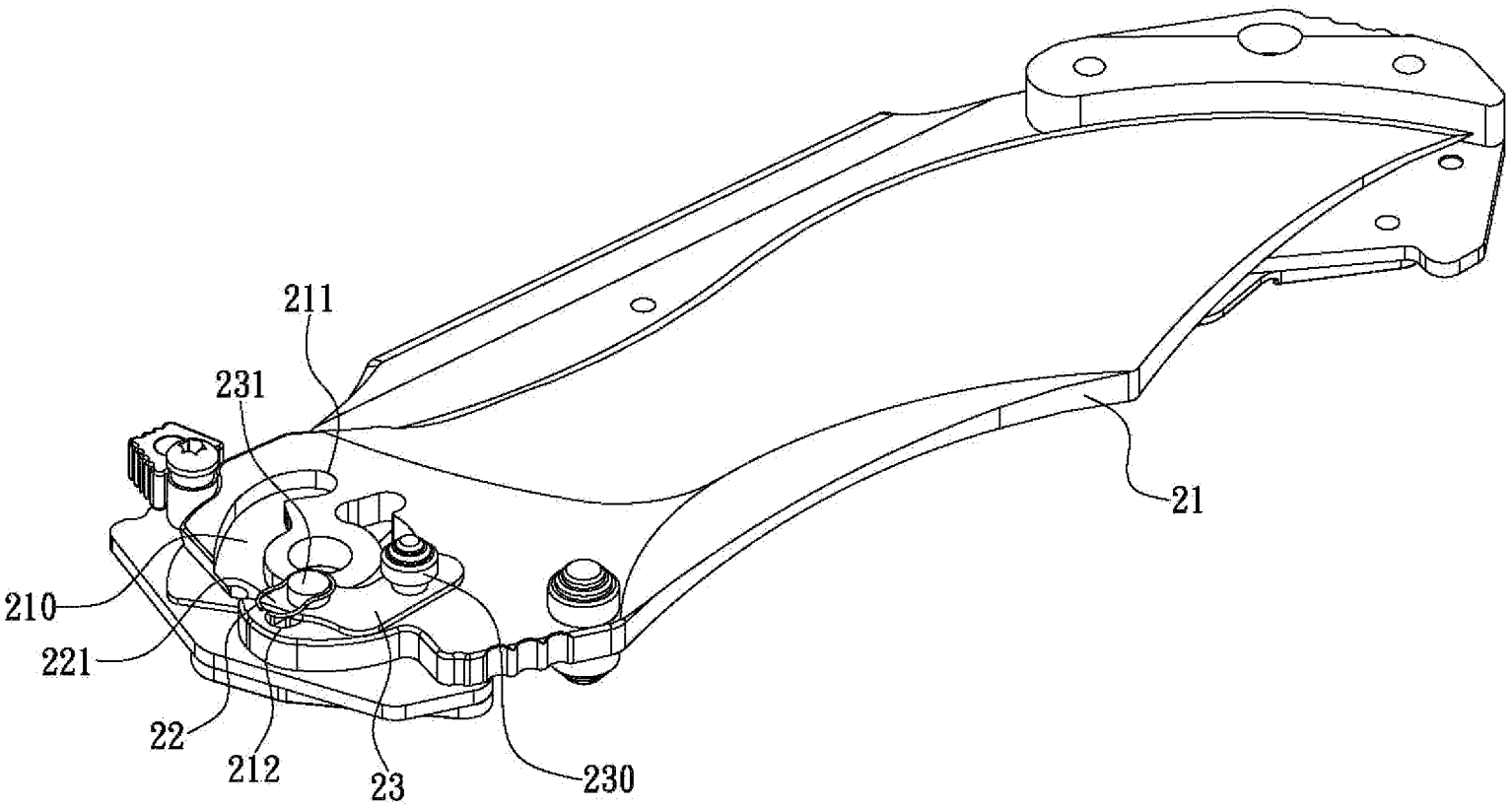
FIG. 6 is a partial perspective view of the preferred embodiment of the present invention showing the blade in the folded state.
Figure 7:
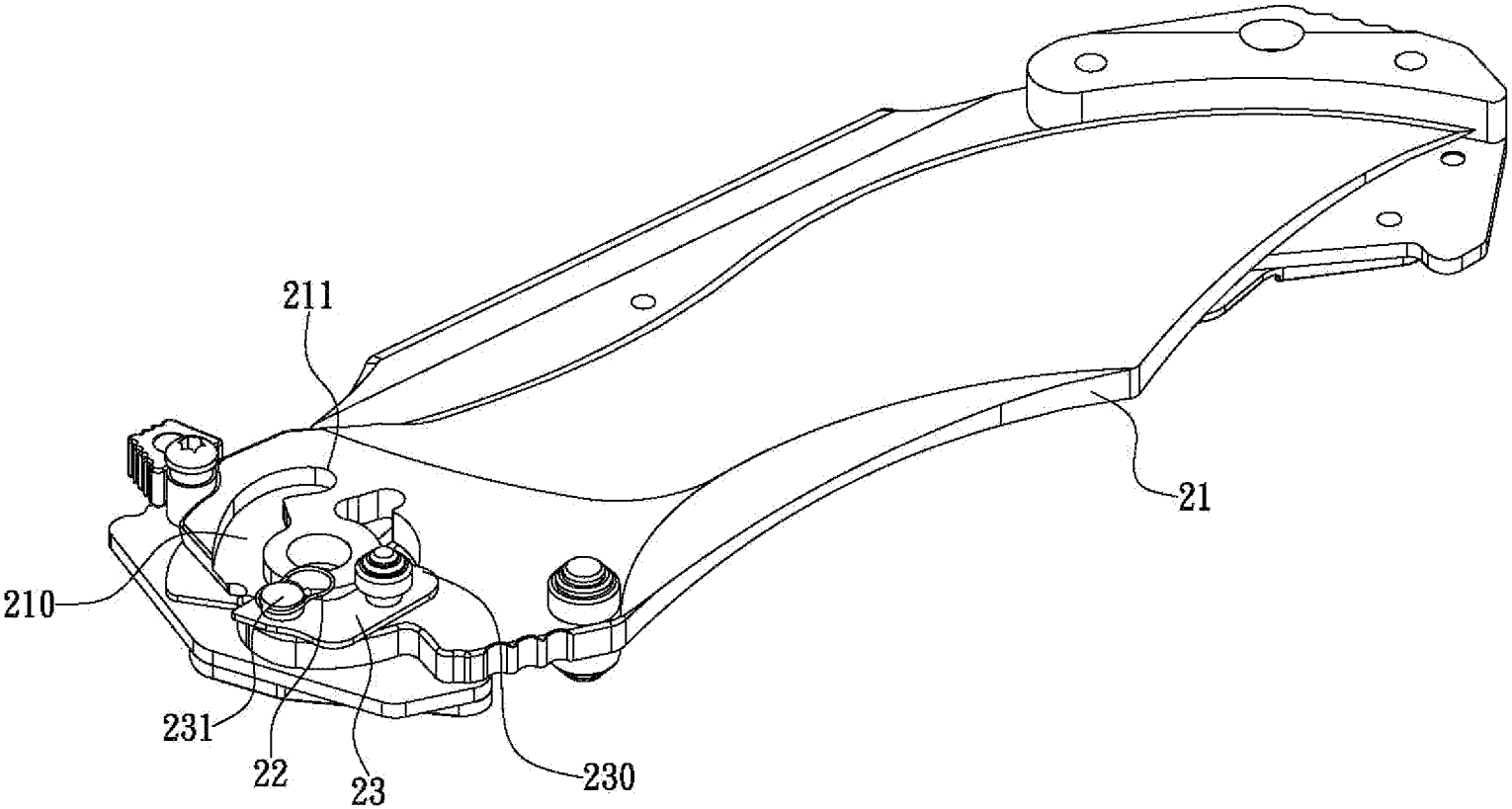
FIG. 7 is another partial perspective view of the preferred embodiment of the present invention showing the blade in the folded state.

Referring to FIG. 6, once the blade 21 is completely received in the handle 20 but the actuation element 23 has not been pushed, the locking member 232 (which corresponds in position to the sliding member 231, as shown in FIG. 2) is not engaged in the folded-state locking groove 212. The blade 21 in this state is not locked by the actuation element 23. When the actuation element 23 is subsequently pushed away from the tip of the blade 21, referring to FIG. 7, the sliding member 231 of the actuation element 23 passes through the limiting portion 220 of the elastic ring 22 and enters the locking area 221 shown in FIG. 6. Thus, the locking member 232 (see FIG. 2) is engaged in the folded-state locking groove 212 shown in FIG. 6 and locks the blade 21 in the folded state.

In summary, with the inwardly curved limiting portion 220 of the elastic ring 22 serving to secure the sliding member 231 of the actuation element 23, the locking member 232 of the actuation element 23 can be firmly engaged in the opened-state locking groove 211 or the folded-state locking groove 212 to ensure the blade 21 is held in the opened or folded state. When it is desired to fold or spin out the blade 21, the user only has to push the pushing member 230, and the locking member 232 will be driven out of the opened-state locking groove 211 or the folded-state locking groove 212 to unlock the blade 21. The technical features of the present invention not only effectively prevent the blade 21 from folding by accident during use, but also prevent the blade 21 from popping out unexpectedly in the folded state. Thus, the user is protected from injury by the blade 21, and the operational safety of the folding knife 2 is enhanced. Further, once the blade 21 is rotated out of or folded into the handle 20, the user can lock the blade 21 by operating the actuation element 23 single-handedly, which features great convenience of use.

While the invention herein disclosed has been described by means of specific embodiments, numerous modifications and variations could be made thereto by those skilled in the art without departing from the scope of the invention set forth in the claims.

What is claimed is:

1. A folding knife with a locking mechanism, comprising:

a handle comprising a first plate element, the handle being provided with a pivot pin, the first plate element being formed with a pushing slide groove and a positioning slide groove, both said slide grooves being adjacent to the pivot pin;

a blade having a portion which is distant from a tip of the blade and is pivotally connected by the pivot pin to a portion of the first plate element that is adjacent to an end thereof, the blade being formed with a curved groove which is adjacent to the pivot pin and extends along a circumferential direction defined by the pivot pin as the center, the curved groove having two terminal ends respectively extended with an opened-state locking groove and a folded-state locking groove, both said locking grooves extending away from the pivot pin;

an elastic ring provided in the positioning slide groove, the elastic ring having a middle section curved inward to form a limiting portion such that a locking area and a releasing area are formed in the elastic ring and are adjacent to two ends of the elastic ring respectively; and an actuation element provided between the first plate element and the blade, the actuation element having a side which faces the first plate element and is protrudingly provided with a pushing member and a sliding member, the pushing member having a first end extending out of the first plate element through the pushing slide groove, the sliding member extending into the elastic ring, the actuation element having an opposite side protrudingly provided with a locking member, the locking member corresponding in position to and being able to extend into the curved groove of the blade, wherein once the blade is fully rotated out of the handle and thus enters an opened state, pushing the actuation element toward the tip of the blade causes the sliding member of the actuation element to pass through the limiting portion and enter the locking area such that the locking member is engaged in the opened-state locking groove and thereby locks the blade in the opened state; and once the blade is fully rotated into the handle and thus enters a folded state, pushing the actuation element away from the tip of the blade causes the sliding member of the actuation element to pass through the limiting portion and enter the locking area such that the locking member is engaged in the folded-state locking groove and thereby locks the blade in the folded state.

2. The folding knife of claim 1, wherein the pushing slide groove has an axial direction parallel to an axial direction of the positioning slide groove.

3. The folding knife of claim 2, wherein the opened-state locking groove extends toward the tip of the blade, and the folded-state locking groove extends away from the tip of the blade.

4. The folding knife of claim 3, wherein the sliding member is greater in width than the limiting portion.

5. The folding knife of claim 4, wherein the actuation element is provided with a rivet hole, and a second end of the pushing member is fixed at the rivet hole by riveting.

6. The folding knife of claim 5, wherein the first end of the pushing member is provided with an anti-slip portion.

7. The folding knife of claim 6, wherein the handle further comprises a second plate element, the blade being pivotally provided between the first plate element and the second plate element, the second plate element being provided with an elastic stop plate, the elastic stop plate having an end which, when the blade is in the opened state, presses against an end of the blade that is adjacent to the pivot pin.

* * * * *